US009573173B2

(12) United States Patent
Sivacoe

(10) Patent No.: US 9,573,173 B2
(45) Date of Patent: Feb. 21, 2017

(54) PIG PUMPING UNIT AND METHOD

(76) Inventor: Orlande Wayne Sivacoe, Red Deer (CA)

( * ) Notice: Subject to any disclaimer, the term of this patent is extended or adjusted under 35 U.S.C. 154(b) by 504 days.

(21) Appl. No.: 12/334,049

(22) Filed: Dec. 12, 2008

(65) Prior Publication Data

US 2009/0196692 A1 Aug. 6, 2009

Related U.S. Application Data

(60) Provisional application No. 61/025,149, filed on Jan. 31, 2008.

(51) Int. Cl.
*B08B 9/00* (2006.01)
*B08B 9/055* (2006.01)

(52) U.S. Cl.
CPC ..... *B08B 9/0551* (2013.01)

(58) Field of Classification Search
CPC ..... B08B 9/0551
USPC ..... 134/22.12; 15/3.5, 104.061, 104.063; 137/17.07
See application file for complete search history.

(56) References Cited

U.S. PATENT DOCUMENTS 4,354,515 A * 10/1982 Sutherland ..... 134/167 C
4,576,097 A * 3/1986 Foster ..... 104/138.2
5,208,936 A 5/1993 Campbell
5,358,573 A * 10/1994 Sivacoe ..... 134/8
5,431,545 A * 7/1995 Knight et al. ..... 417/248
6,569,255 B2 5/2003 Sivacoe
6,769,152 B1 * 8/2004 Crenshaw et al. ..... 15/104.062

OTHER PUBLICATIONS

Tiratsoo, J.N.H., Pipeline Pigging Technology, 2nd Ed., 1992, Gulf Professional Publishing, pp. 449,451.*
Tiratsoo, John, Pipeline Pigging and Integrity Technology, 3rd Ed., 2007, Clarion Technical Publishers, pp. 35-46.*
Tiratsoo, J.N.H, Pipeline Pigging Technology, 2nd Ed., 1992, Gulf Professional Publishing, p. 455.*
Tiratsoo, Pipeline Pigging and Integrity Technology, 3rd Ed., 2003, pp. 16 and 17.*

* cited by examiner

*Primary Examiner* — Eric Golightly
*Assistant Examiner* — Arlyn I Rivera-Cordero
(74) *Attorney, Agent, or Firm* — Christensen O'Connor Johnson Kindness PLLC

(57) ABSTRACT

A pumping unit is provided that controls fluid pressure in a pipe being traversed according to the degree of resistance encountered by a pig traversing the pipe under fluid pressure. Increasing fluid pressure in constricted areas enables an intelligent pig to traverse the pipe with a more uniform speed by controlling the fluid velocity.

4 Claims, 2 Drawing Sheets

PIG PUMPING UNIT AND METHOD

CROSS-REFERENCE TO RELATED APPLICATIONS

This application claims the benefit under 35 USC 119(e) of provisional application No. 61/025,149 filed Jan. 31, 2008.

FIELD OF THE INVENTION

Pipe cleaning methods and apparatus.

BACKGROUND

Oil refineries frequently include many kilometers of pipes that require cleaning, as for example in fired heaters, where oil is heated during the refining process. One well established cleaning technique is to run a pig through the pipes under hydraulic pressure to clean the pipes. Pigs are typically polyurethane or strangulated foam cylinders or balls that are studded with scraping elements. The inventor has been a pioneer in the art of pigging, and has obtained U.S. Pat. No. 6,569,255 for a Pig and method for cleaning tubes, U.S. Pat. No. 6,391,121 for a Pig and method for cleaning tubes, U.S. Pat. No. 6,359,255 for a Pipe inspection device and method, U.S. Pat. No. 6,170,493 for a Method of cleaning a heater, U.S. Pat. No. 5,685,041 for a Pipe pig with abrasive exterior, U.S. Pat. No. 5,379,475 for a Scraper for a Pipe Pig, U.S. Pat. No. 5,358,573 for a Method of cleaning a pipe with a cylindrical pipe pig having pins in the central portion, U.S. Pat. No. 5,318,074 for a Plug for a furnace header, U.S. Pat. No. 5,265,302 for a Pipeline Pig and U.S. Pat. No. 5,150,493 for a Pipeline Pig.

Intelligent pigs that carry sensors are run through pipes, as for example the pipes in fired heaters, to inspect the pipes with the sensors. It is preferred that the intelligent pigs run at a constant speed. However, the intelligent pigs tend to slow down when encountering obstacles in the pipe. This can cause problems for the operator of the intelligent pig.

SUMMARY

A pumping unit and method are provided that control fluid pressure in a pipe being cleaned according to the degree of resistance encountered by a pig traversing the pipe under fluid pressure. Increasing fluid pressure in constricted areas enables an intelligent pig to traverse the pipe with a more uniform speed.

These and other aspects of the device and method are set out in the claims, which are incorporated here by reference.

BRIEF DESCRIPTION OF THE FIGURES

Embodiments will now be described with reference to the figures, in which like reference characters denote like elements, by way of example, and in which.

DETAILED DESCRIPTION

In the claims, the word "comprising" is used in its inclusive sense and does not exclude other elements being present. The indefinite article "a" before a claim feature does not exclude more than one of the feature being present. Each one of the individual features described here may be used in one or more embodiments and is not, by virtue only of being described here, to be construed as essential to all embodiments as defined by the claims.

Figure 1:
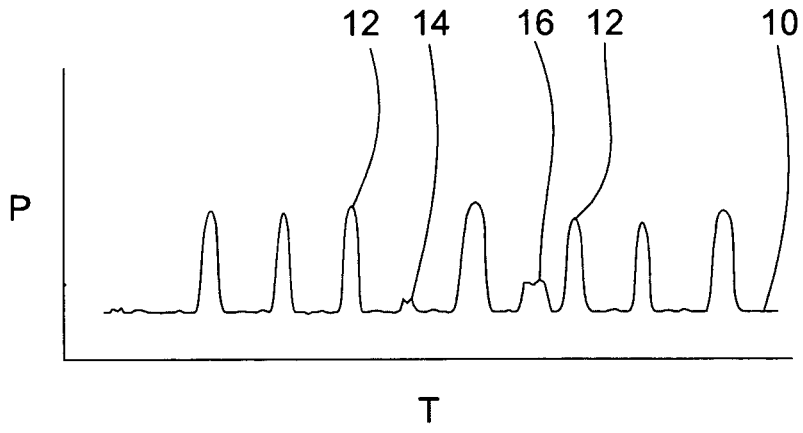
FIG. 1 is a graph showing a pressure recording chart for a pigging operation.

Referring to FIG. 1, pressure on a pig is sensed while it traverses a pipe. A pressure recorder generates a trace 10 that records the pressure in the pipe on the high pressure side of the pig. When the pig encounters bends in the pipe, it encounters resistance, which produces pressure spikes 12 in the trace 10. The pressure spikes 12 can be used to detect the location of the pig since the bends in the pipe are usually known. When the pig encounters an area of low contamination, the pressure increases as indicated at 14 and when the pig encounters an area of high contamination, the pressure increases as indicated at 16. To maintain the pig at constant speed, when the pressure as recorded by the pressure recorder exceeds a pre-set pressure, a throttle valve (variable flow control valve) is opened to temporarily increase pressure on the pig and thus help maintain pig speed at a constant level.

Figure 2:
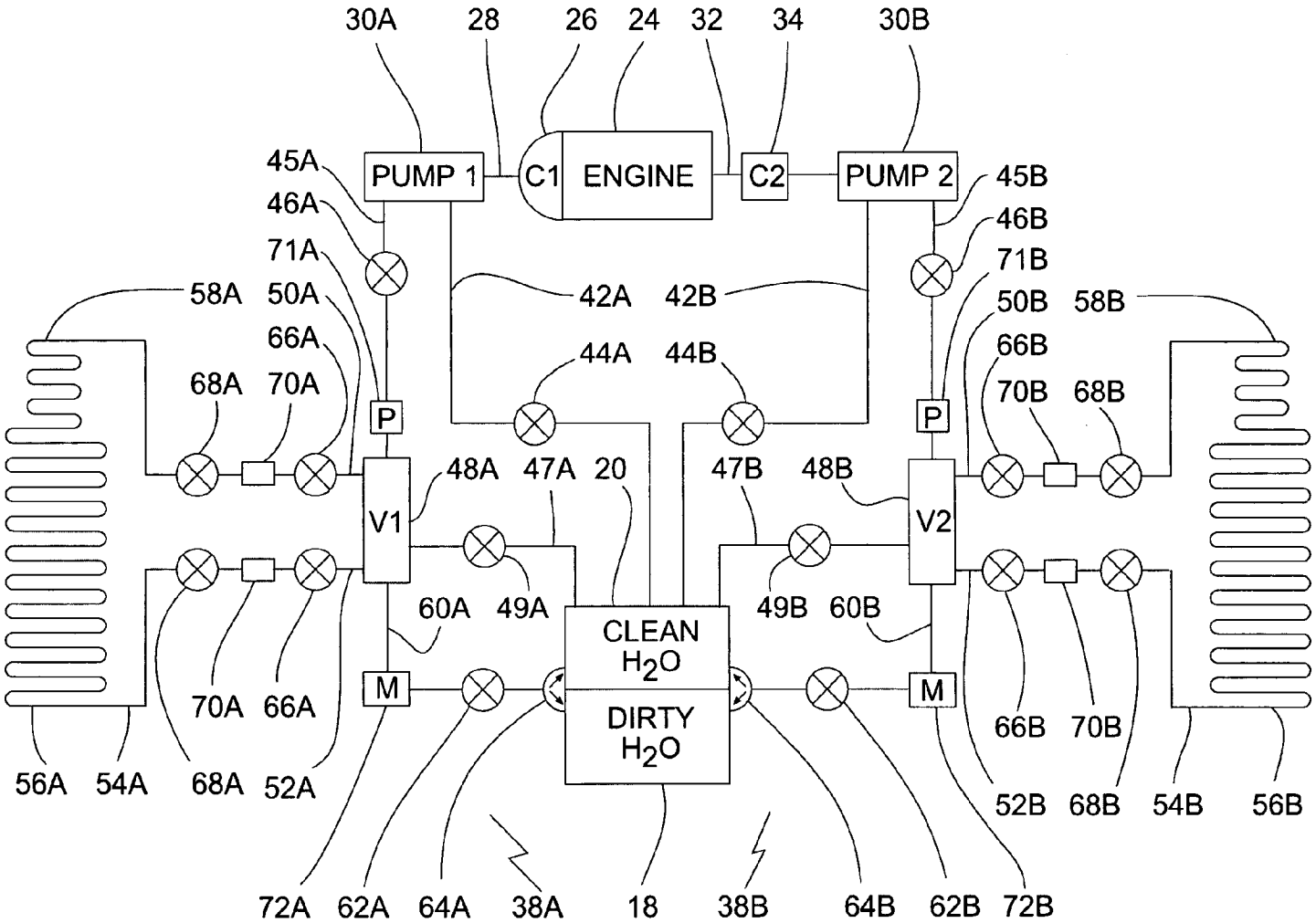
FIG. 2 is a schematic showing details of an engine driving two pumps, each pump being connected into a respective pumping circuit that is connected into a pipe to be cleaned.

Referring to FIG. 2, an engine and pump configuration is shown that may be used to increase pressure on a pig temporarily as it passes obstructions in the pipe. While FIG. 2 depicts a double-pass unit, it will be understood that the teachings herein may be applied to a single-pass unit, a four-pass unit, etc. In situations where there is more than one pass, and the teachings are used primarily as an inspection tool, it may be more economical to implement the teachings on only one path. However, the teachings may be used for more than just inspection purposes, and may be applied to each path in a unit. In FIG. 2, engine 24 has an integral clutch 26 from which extends a drive shaft 28. The drive shaft 28 is connected to drive pump 30A (P1). The engine 24 is shown with only one integral clutch, but has a main shaft 32 that extends from the end of the engine 24 opposite to the clutch 26. Main shaft 32 is connected through a stand alone clutch 34 to drive pump 30B (P2). Other clutch and drive shaft configurations may be used to configure a single engine to drive two pumps. In this way, for example, engine 24 may be connected to drive two pumps. Each pump P1-P4 is connected into a valved pumping circuit. An exemplary configuration of two such valved pumping circuits 38A, 38B associated with engine 24 is shown in FIG. 2. The valved pumping circuits 38A and 38B may be constructed in the same way, and thus in the detailed description that follows, only valved pumping circuit 38A is described, the description for valved pumping circuit 38B being the same, except replacing the suffix A with the suffix B in the reference characters.

Pump 30A has an inlet conduit 42A with valve 44A that extends into the clean water tank 20 to provide a supply of clean water to pump 30A. In practice, pump 30A may have one or more such inlets, with different sizes, for example 4 inch or 12 inch inlets. The inlet conduit 42A may be made of a suitable combination of rigid pipe and flexible hoses. Pump 30A has a power outlet conduit 45A with valve 46A that leads to a valve bank 48A. Valve bank 48A has suitable connections 50A, 52A for connecting to either end of a pipe 54A to be cleaned. The pipe 54A may be a pipe in a fired heater. In a fired heater, the pipe typically passes through a radiant heating section 56A (denoted red side) and a convection heating section 58A (denoted blue side). The valve bank 48A itself is conventional and typically comprises four valves for routing fluid either direction through the pipe 54A, and operates together with a bypass valve 49A on bypass line 47A for returning fluid directly back to the clean water tank 20. The bypass line 47A is used for example when using the valve bank 48A to switch between flow directions in the pipe 54A. The valve bank 48A has a return conduit 60A for routing water back to either the dirty water tank 18 or clean water tank 20 through valve 62A and diverter valve 64A. Diverter valve 64A operates to discharge water that has passed through the pipe 54A into either the dirty water tank 18 or clean water tank 20. The return conduit 60A may be any suitable combination of piping and hoses.

The connections 50A, 52A are each provided with valves 66A, 68A and a pig launcher/receiver 70A. The pig launcher/receivers 70A may be placed in parallel or in series with the connections 52A, 54A, and various configurations of pig launcher/receiver may be used. One or more pressure sensors are included in the pumping circuit, such as pressure sensor 71A between the pump 30A and the connection 50A, and pressure sensor (not shown) between connection 52A and dirty and clean water tanks 18 and 20. Alternatively, a differential pressure sensor (not shown) may be included to determine the difference in pressure between heater sections 58A and 56A. This may be positioned at any convenient location.

The valved pumping circuit 38A is provided with at least one variable flow control valve. The variable flow control valve or valves regulate flow in the valved pumping circuit 38A and may for example be incorporated into the valved pumping circuit 38A in various ways, such as into the pump 30A, or as a stand alone valve or valves in the valved pumping circuit 38A. At least one variable flow valve should be placed between the pump 30A and the pipe 54A. For example, valve 46A may be a variable flow valve. Valve 46A may also be referred to as a throttle valve. Valve 62A on return conduit 60A between the valve bank 48A and the clean/dirty water tanks 18, 20 may also be a variable flow control valve. More than one variable flow valve may be used for each the valves 46A and 62A. In one embodiment, the valve 62A may be located at the dirty/clean water tanks 18, 20 on the return conduit 60A and may be supported by the tanks 18, 20. The return conduit 60A may be provided with a flow meter 72A. Valves 66A or 68A may be variable flow control valves.

Figure 3:
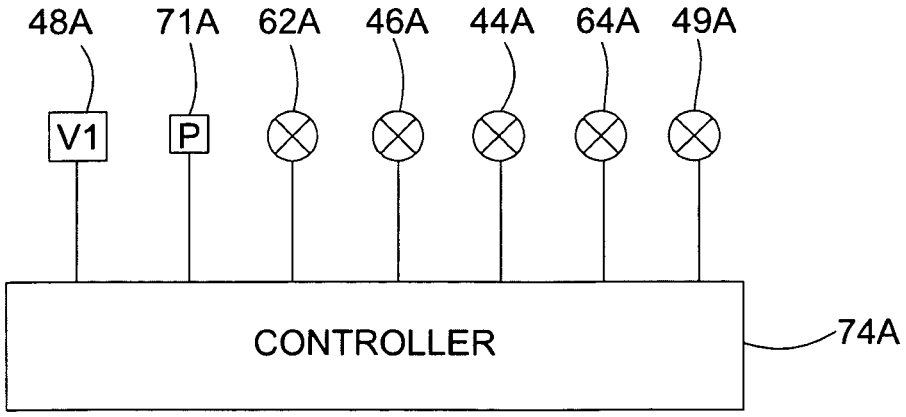
FIG. 3 is a simplified diagram of a controller for controlling flow in a pumping circuit.

Referring to FIG. 3, a controller 74A is connected to receive signals from the pressure sensors including pressure sensor 71A, and is connected to control at least the one or more variable flow control valves, for example valve 46A and valve 62A, and may also control the valve bank 48A, and the valves 44A, 46A, 49A and 64A. In some cases, it may be desirable to have separate control inputs for the throttle or other valves, where one input is the coarse adjustment, which allows for rapid changes in pressure such as when initially applying the pressure, and another input that allows for fine adjustment which is used to maintain the system within a desired pressure range. The controller 74A may for example be at a console in an operator's cabin, and may be manual, partly manual and partly automatic, or fully automatic. Automatic controllers for hydraulic systems are well known and need not be described in detail here, but generally include a processor with inputs and outputs that runs on instructions implemented through hardware or software that is connected to a memory unit, and may be programmed or otherwise configured to control the pump circuit in the manner described here. In particular, due to desirability of fast response, the variable flow control valves 46A and 62A are automatically controlled in response to the controller 74A receiving pressure signals from the pressure sensor 71A.

As will be recognized by those in the art, controller 74A may have a control box portion for receiving manual inputs, and a control circuitry portion with a process that is programmed to make decisions based on the inputs. The control circuitry portion may also include automatic control circuitry, which would reduce the need for manual inputs and supervision.

Each pumping circuit and pump is operated in conventional manner, with modifications described here. Operation of circuit 38A is described, but the same principles apply to circuit 38B. Initially, clean water is passed through the pipe 54A and returned to the clean water tank 20 to ensure a free flow path. Pipe 54A is first connected into the pumping circuit 38A including pig launchers 70A. Engine 24 is used to drive the pump 30A. Fluid flow in the pumping circuit 38A is controlled by the variable flow control valves such as throttle valves 46A and 62A. The engine for the pump 30A may be operated at constant speed, with flow control provided by the variable flow control valves such as valves 46A and 62A. A second engine with two additional pumping circuits and pumps may likewise be used to clean third and fourth pipes.

The pipe 54A may be cleaned by running pigs through specific sections repeatedly by reversing flow using the valve bank 48A operated by controller 74A. In addition, the pipe 54A may be inspected by running an intelligent pig through the pipe 54A with the variable flow control valves, such as valves 46A and 62A, partly closed. Flow bypass and diversion may also be accomplished by control from the controller 74A in a conventional manner. Location of the pigs may be determined from the upstream pressure recorder 71A in the manner described above in relation to FIG. 1. As the pigs pass bends or other obstructions in the pipe being cleaned, the pressure spikes, which may be sensed by the controller 74A comparing the pressure as sensed by the upstream pressure sensor 71A with a pre-set value. Upon the fluid pressure in the pipe 54A exceeding the pre-set value, which may be determined experimentally, the variable flow control valve or valves are opened beyond the partly closed state for at least a period of time, that is, temporarily, to increase fluid pressure on the pig.

At the end of the period of time, the one or more variable flow control valves are returned to a partly closed state. The period of time may be determined in various ways. For example, the period of time may be a pre-set time, or may end when the fluid pressure in the pipe returns to the pre-set value or a second pre-set value, or may be determined by the rate of pressure increase when the fluid pressure exceeds the pre-set value.

Opening the one or more variable flow control valves temporarily increases pressure on the pig in the pipe 54A. The pig, having slowed down at the obstruction (such as obstruction 12, 14 or 16), then speeds up. If automatic control is used, the speeding up is almost immediate. Upon exiting the obstruction, the return of the at least one variable flow control valve to the partly closed state reduces pressure on the pig, and the pig will not be speeded up past the obstruction. By operation of the variable flow control valves temporarily closing while the pig encounters an obstruction, the pig is maintained at a more uniform speed. Although a single variable flow control valve between the pump 30A and the pipe 54A may suffice, it is preferred to use a second variable flow control valve between the pipe 54A and the clean/dirty water tanks 18, 20.

In situations where it is desirable to have the pig travel at a more constant velocity, such as when the pipe 54A is being inspected by an intelligent pig, valve 62A may be used as a second variable flow control valve, such that a back pressure is applied in addition to the motive force behind the pig. The back pressure helps reduce any undesired increases in speed when the motive force behind the pig is increased to compensate for an increase in friction. In other words, applying a back pressure prevents the pig from surging forward more rapidly than desired when pressure is applied to increase its speed, by maintaining the pig within a desired pressure differential range. It will be understood that since it is the pressure differential that controls the speed of the pig, the motive force may also be increased by decreasing the back pressure. For example, it has been found that the pig requires a minimum pressure differential of about 100-150 psi to initiate movement of the pig. Thus, it is useful in this embodiment to measure the pressure differential between the pressure sensor 71A upstream from the pig and an additional pressure sensor (not shown) downstream from the pig. Alternatively, a differential pressure sensor may be included to measure the differential pressure, rather than having to compare the two pressure sensor readings. This would also be more useful if automatic controls were used. For example, a differential pressure sensor may be contained within valve bank 48A to measure the pressure difference between the blue output to section 58A and the red output to section 56A of the valve bank 48A, or any other convenient location. The flow meter 72A can be used to provide information for the fluid flow velocity required for optimum operation of the intelligent pig. In addition, instead of monitoring the pressure readings to maintain the desired speed, an operator may instead monitor the flow meter to maintain a proper fluid velocity, and use the pressure readings to ensure that the pressures are in an appropriate range. Other sensors may also be included to monitor the system.

A single operator may manage two pipes being cleaned at a time, so that two operators in a single pumping unit may manage four pipes being cleaned at a time. A single pig handler may be used for all four pumping circuits, so that the total staff required to perform four passes at a time is three and only a single pumping unit is required.

Immaterial modifications may be made to the embodiments described here without departing from what is covered by the claims.

What is claimed is:

1. A method of pigging a pipe with an intelligent pig, the method comprising:

running the intelligent pig through the pipe under propulsion by fluid pressure in the pipe; and while the intelligent pig is traversing the pipe and encountering obstructions that include bends in the pipe, opening a partly closed variable flow control valve to temporarily increase differential fluid pressure between upstream of the pig and downstream of the pig in response to detecting an increase in pressure when the intelligent pig encounters an obstruction, in which the increase of differential fluid pressure is terminated after a period of time when the pig has cleared the obstruction by at least partly closing the variable flow control valve, the temporarily increasing differential fluid pressure causing a reduction in pig speed variation and reduced departure from a uniform speed of the intelligent pig as the intelligent pig traverses the pipe.

2. The method of claim 1 in which the period of time is pre-set.

3. The method of claim 1 in which the period of time ends when the increase in pressure resulting from the intelligent pig encountering the obstruction decreases to zero.

4. The method of claim 1 in which the period of time is determined by the rate of the increase in pressure resulting from the intelligent pig encountering the obstruction.

* * * * *